US006705793B2

(12) United States Patent
Wyant

(10) Patent No.: US 6,705,793 B2
(45) **Date of Patent: *Mar. 16, 2004**

(54) BINDER WITH HOLE PUNCH

(75) Inventor: Jon R. Wyant, Centerville, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/488,599

(22) Filed: Jan. 20, 2000

(65) Prior Publication Data

US 2002/0064414 A1 May 30, 2002

(51) Int. Cl.[7] ..... B42F 3/00; B42F 13/40

(52) U.S. Cl. ..... 402/4; 402/1; 402/70; 402/502; 281/30; 281/31; 281/29; 281/21.1; 281/15.1; 30/358; 30/360; 30/363; 30/458; 30/459; 83/167

(58) Field of Search ..... 402/1, 4, 70, 502; 281/31, 15.1, 21.1, 29, 30; 30/458, 459, 358, 360, 363; 83/167

(56) References Cited

U.S. PATENT DOCUMENTS

| | | | | | |
|---|---|---|---|---|---|
| 606,508 | A | | 6/1898 | Boykin | |
| 1,142,032 | A | | 6/1915 | Faifer | |
| 1,218,849 | A | * | 3/1917 | Fredrickson | 281/31 |
| 1,285,048 | A | * | 11/1918 | Cooke | 30/316 |
| 1,336,998 | A | | 4/1920 | Bottle | |
| 1,726,219 | A | | 8/1929 | Gammeter | |
| 2,139,159 | A | | 12/1938 | Hammen | 129/7 |
| 2,318,192 | A | * | 5/1943 | Boelema, Jr. | 281/31 |
| 2,370,319 | A | * | 2/1945 | Lippincott | 30/316 |
| 2,445,440 | A | | 7/1948 | Klemm | 164/119 |
| 3,172,325 | A | * | 3/1965 | Wernham et al. | 83/599 |
| 3,595,554 | A | | 7/1971 | Donovan | 269/2 |
| 3,975,105 | A | | 8/1976 | Cline | 402/1 |
| 4,729,688 | A | | 3/1988 | Manz | 402/1 |
| 4,743,048 | A | | 5/1988 | Groswith, III | 281/21 R |
| 4,749,297 | A | | 6/1988 | Roy | 402/1 |
| 4,961,596 | A | * | 10/1990 | Moor | 281/31 |
| 5,005,458 | A | | 4/1991 | Merrick | 83/599 |
| 5,058,736 | A | | 10/1991 | Bedol | 206/214 |
| 5,209,592 | A | | 5/1993 | Bedol | 402/1 |
| 5,273,370 | A | | 12/1993 | Bland et al. | 402/1 |
| 5,291,813 | A | * | 3/1994 | Blumenthal et al. | 83/599 |
| 5,340,229 | A | | 8/1994 | Schwartzman | 402/4 |
| 5,403,108 | A | | 4/1995 | Karlis | 402/1 |
| 5,409,319 | A | | 4/1995 | Bedol | 402/1 |
| 5,429,445 | A | | 7/1995 | Un-tae | 402/1 |
| 5,490,440 | A | | 2/1996 | Karlis et al. | 83/599 |
| 5,501,128 | A | | 3/1996 | D'Amore | 83/599 |
| 5,503,052 | A | * | 4/1996 | Rigney et al. | 83/467.1 |
| 5,553,958 | A | | 9/1996 | Bedol | 402/1 |
| 5,638,730 | A | * | 6/1997 | Karlis | 83/167 |
| 5,727,323 | A | * | 3/1998 | Cerrato | 30/458 |
| 5,839,843 | A | | 11/1998 | Bedol | 402/4 |
| 5,845,407 | A | * | 12/1998 | Cerrato | 30/458 |
| D408,453 | S | * | 4/1999 | Mori | D19/72 |

* cited by examiner

*Primary Examiner*—A. L. Wellington
*Assistant Examiner*—Mark T. Henderson
(74) *Attorney, Agent, or Firm*—Thompson Hine LLP

(57) ABSTRACT

A binder for receiving and retaining loose leaf papers comprising a cover, a binding mechanism coupled to the cover, and a hole punch coupled to the cover. The hole punch is configured to punch a set of holes in a sheet of paper such that the binding mechanism can be received through the set of holes to receive and retain the paper in the binder.

13 Claims, 2 Drawing Sheets

BINDER WITH HOLE PUNCH

The present invention is directed to a binder for receiving loose papers, and more particularly, to a binder for receiving loose papers, the binder having a hole punch.

BACKGROUND OF THE INVENTION

Binders are used by students and professionals to store loose leaf papers and other loose items. The binders typically include a binding mechanism, such as a conventional three ring binder, to bind the papers together. However, many papers, such as hand-outs, photocopies, large or irregular-sized papers, and the like do not have pre-punched holes. In these cases, holes must be punched in the papers using a hole punch mechanism before the papers can be received in the binder. However, a hole punch may not always be readily available, and it can be difficult to predict when a hole punch may be needed. Furthermore, standard hole punches can be quite bulky and heavy, and therefore inconvenient to carry. Accordingly, there is a need for a binder that can form holes into a paper such that the papers can be received in the binding mechanism of the binder.

SUMMARY OF THE INVENTION

The present invention is a binder having a hole punch mechanism. The hole punch is preferably mounted to the cover of the binder, and is configured to punch holes in a piece of paper such that the punched paper can be received in the binding mechanism of the binder. The present invention eliminates the need to carry a separate hole punch, and ensures that a hole punch mechanism is available whenever unpunched papers are desired to be placed into the binder.

In one embodiment, the invention is a binder for receiving and retaining loose leaf papers comprising a cover, a binding mechanism coupled to the cover, and a hole punch coupled to the cover. The hole punch is configured to punch a set of holes in a sheet of paper such that the binding mechanism can be received through the set of holes to receive and retain the paper in the binder.

Other objects and advantages of the present invention will be apparent from the following description and the accompanying drawings.

DETAILED DESCRIPTION

Figure 1:
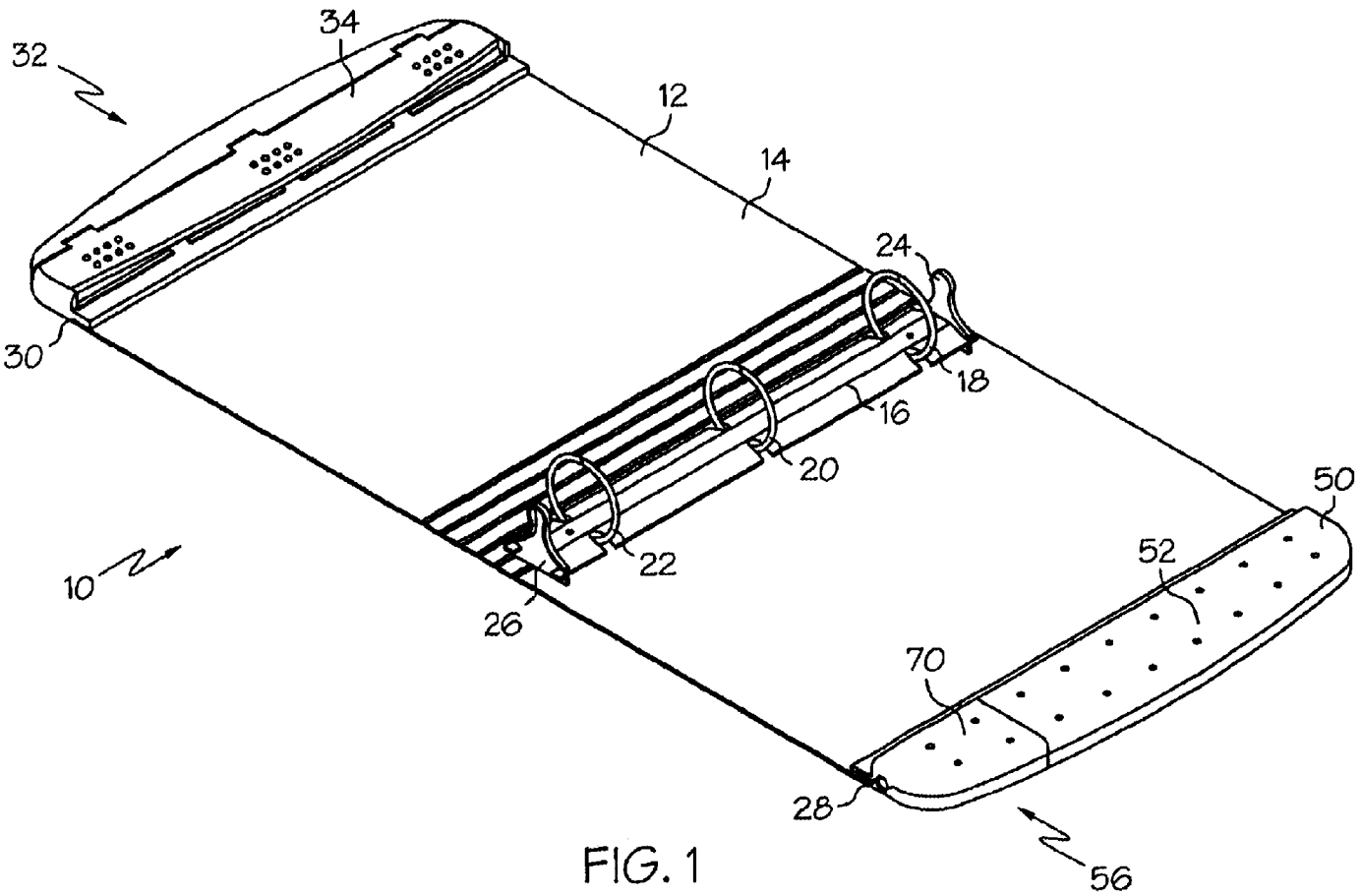
FIG. 1 is a top view of the binder of the present invention, with the hole punch, receptacle and pencil sharpener in their closed positions.

As shown in FIG. 1, the binder 10 of the present invention includes a cover 12 having an inner surface 14 and a binding mechanism 16 coupled to the inner surface of the cover. The binding mechanism 16 is shown as a conventional three ring binder, although a variety of binding mechanisms may be used without departing from the scope of the present invention. The illustrated binding mechanism 16 includes a set of openable rings 18, 20, 22 that are actuable by a set of triggers 24, 26. The rings 18, 20, 22 are preferably generally evenly spaced apart a distance of about 4¼ inches.

Figure 2:
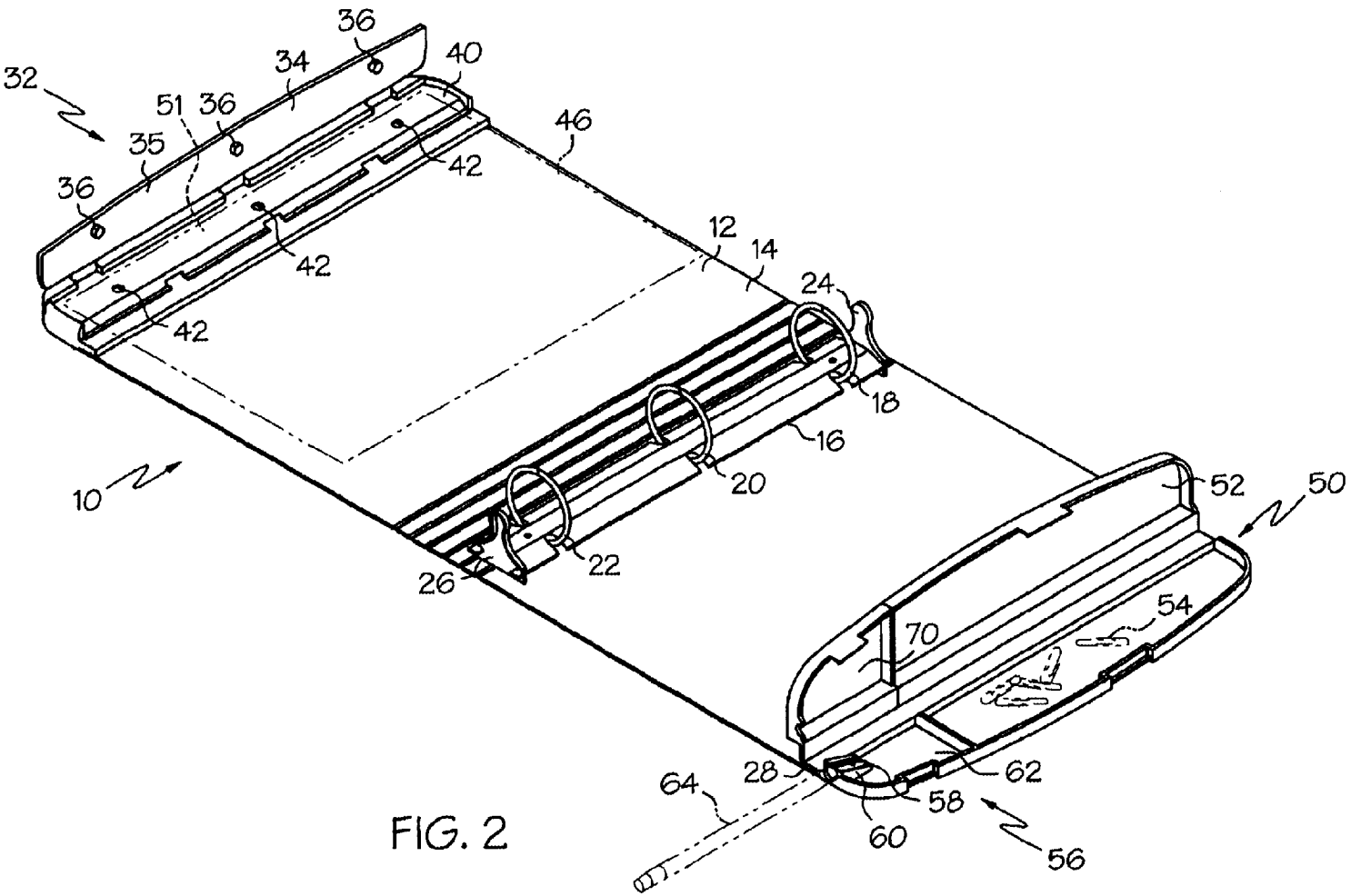
FIG. 2 is a top view of the binder of FIG. 1, with the hole punch, receptacle and pencil sharpener in their open positions.

The cover 12 includes a pair of opposed outer edges 28, 30, and a hole punch 32 is located adjacent the outer edge 30. The hole punch 32 includes a movable handle 34 having a set of protrusions 36 on the lower surface of the handle 34 (FIG. 2). The hole punch 32 also includes a base 40 having a set of recesses 42 that are aligned with the protrusions 36. In order to punch a hole in a sheet of paper 46, the handle 34 is moved to its open position, as shown in FIG. 2. A paper 46 is then slid on top of the base 40 such that the paper is located between the handle 34 and the base 40. The handle 34 is then moved to the closed position such that the protrusions 36 are received in a respective recess 42, thereby punching a set of holes in the paper 46. The handle 34 and base 40 are preferably made of a light weight plastic material, such as acrylonitrile butadiene styrene (ABS) to provide a light weight hole punch 32.

The protrusions 36 and recesses 42 are preferably aligned such that the hole punch 32 forms a set of holes in the paper 46 that correspond to the spacing of the rings 18, 20, 22. In this manner, a sheet of paper punched with the hole punch 32 can be received in the binding mechanism 16. Of course, various other holes punches besides the hole punch 32 shown herein may be used without departing from the scope of the present invention. For example, the protrusions 36 may be located on the base 40 and the recesses 42 may be located on the handle 34. Furthermore, many other mechanisms beyond cooperating protrusions and recesses may be used as a hole punch mechanism. Preferably the hole punch 32 is configured to punch holes in a sheet of paper 46 such that the binding mechanism 16 can pass through the holes to receive and retain the paper in the binder 10. Further preferably the hole punch 32 forms the requisite holes in a single motion of the hole punch 32, such that multiple punchings of the paper 46 are not required.

The binder 10 further includes a receptacle 50 having a closable lid. The receptacle 50 can be used to hold various loose items (such as the paper clips 54 shown in FIG. 2) in a location that is convenient to the user. The binder 10 also has a pencil sharpener 56 located adjacent the receptacle 50. The pencil sharpener 56 includes a blade 58 mounted into a blade holder 60, and has a shavings receptacle 62 adjacent the blade holder 60 to receive the shavings generated by sharpening a pencil 64. The shavings receptacle 62 includes a closable lid 70 such that the shavings in the shaving receptacle 62 can periodically be emptied.

The pencil sharpener 56 and the receptacle 50 are located along the edge 28 of the cover 12. As shown in FIG. 1, when in the closed position the pencil sharpener 56 and receptacle 50 form a shape along the edge 28 that is similar to the shape of the hole punch 32 (in its closed position) along the edge 30. Furthermore, when the binder 10 is in a closed configuration, the handle 34 of the hole punch 32 engages lid 52 of the receptacle and the lid 70 of the pencil sharpener 56, which helps to maintain the alignment of, and prevent excess bending of, the cover 12 of the binder 10.

Having described the invention in detail and by reference to the preferred embodiments, it will be apparent that modifications and variations thereof are possible without departing from the scope of the invention.

What is claimed is:

1. A binder for receiving and retaining loose leaf papers comprising:

a cover including an outer surface, an inner surface and a pair of opposed outer edges, said cover being foldable to a closed position;

a binding mechanism coupled to said inner surface of said cover;

at least one of a pencil sharpener or receptacle coupled to and located on said inner surface and generally adjacent to one of said opposed outer edges; and a hole punch mechanism coupled to said inner surface of said cover and generally adjacent to the other of said outer edges such that said hole punch mechanism and said at least one of said pencil sharpener or receptacle abut when said cover is in said closed position, said hole punch mechanism including a base fixedly and non-rotatably coupled to said cover and a handle pivotally mounted to said base, one of said handle or said base including a set of protrusions, the other of said handle or base including a set of recesses aligned with said protrusions such that said handle is pivotable between a closed position wherein each protrusion is received in a corresponding recess and an open position wherein each protrusion is not received in its corresponding recess.

2. The binder of claim 1 wherein said binding mechanism includes a three binding rings having a predetermined spacing pattern, and wherein said hole punch mechanism is configured to form three holes in a sheet of paper having a spacing that corresponds to said predetermined spacing pattern of said binding rings.

3. The binder of claim 1 wherein said hole punch is configured to from three holes in said sheet of paper, said three holes being generally uniformly spaced apart a distance of about 4¼ inches.

4. The binder of claim 1 wherein said handle and said base are made of acrylonitrile butadiene styrene.

5. The binder of claim 1 wherein said at least one of a pencil sharpener or receptacle is a pencil sharpener coupled to said cover.

6. The binder of claim 1 wherein said at least one of a pencil sharpener or receptacle is a receptacle having a closable lid coupled to said cover.

7. The binder of claim 1 wherein said handle pivots about a hinge towards said binding mechanism when said handle moves from said open position to said closed position, wherein said hinge is located adjacent to said other one of said outer edges of said cover such that if said handle were pivoted to a fully open position such that said handle were generally parallel to said cover and not in said closed position, said handle would be located at least partially outside of said other one of said outer edges.

8. The binder of claim 1 wherein said handle pivots toward said binding mechanism when said handle moves from said open position to said closed position.

9. The binder of claim 1 wherein each protrusion is located on said handle and each recess is located on said base.

10. The binder of claim 1 wherein said handle is pivotable about a hinge and wherein said hinge is located adjacent to said other one of said outer edges of said cover such that the distance between said hinge and said other one of said outer edges is less than a width of said handle.

11. The binder of claim 1 wherein includes said set of protrusions and said base includes said set of recesses.

12. The binder of claim 7 wherein said hinge is located adjacent to said other one of said outer edges of said cover such that the distance between said hinge and said other one of said outer edges is less than a width of said handle.

13. The binder of claim 10 wherein said hinge is located adjacent to said other one of said outer edges such that if said handle were pivoted to a fully open position such that said handle were generally parallel to said cover and not in said closed position, said handle would be located at least partially outside of said other one of said outer edges.

* * * * *

UNITED STATES PATENT AND TRADEMARK OFFICE

CERTIFICATE OF CORRECTION

PATENT NO. : 6,705,793 B2
DATED : March 16, 2004
INVENTOR(S) : Jon R. Wyant

It is certified that error appears in the above-identified patent and that said Letters Patent is hereby corrected as shown below:

Column 3,
Line 17, delete “a” before the word “three”,
Line 23, change the word “from” to -- form --.

Column 4,
Line 20, after the word “wherein” insert -- said handle --.

Signed and Sealed this

Sixth Day of July, 2004

JON W. DUDAS
*Acting Director of the United States Patent and Trademark Office*